US011536519B2

(12) United States Patent
Schönberger et al.

(10) Patent No.: US 11,536,519 B2
(45) Date of Patent: Dec. 27, 2022

(54) SUPPORT OF HEAT EXCHANGERS MADE OF WOUND TUBES

(71) Applicant: Linde GmbH, Pullach (DE)

(72) Inventors: Manfred Schönberger, Tacherting (DE); Günther Drese, Polling (DE); Alexander Randlinger, Tacherting (DE)

(73) Assignee: Linde GmbH, Pullach (DE)

( * ) Notice: Subject to any disclaimer, the term of this patent is extended or adjusted under 35 U.S.C. 154(b) by 0 days.

(21) Appl. No.: 17/263,004

(22) PCT Filed: Jul. 23, 2019

(86) PCT No.: PCT/EP2019/025243
§ 371 (c)(1),
(2) Date: Jan. 25, 2021

(87) PCT Pub. No.: WO2020/025167
PCT Pub. Date: Feb. 6, 2020

(65) Prior Publication Data

US 2021/0310753 A1 Oct. 7, 2021

(30) Foreign Application Priority Data

Jul. 28, 2018 (DE) ..... 102018006007.2

(51) Int. Cl.
*F28F 9/013* (2006.01)
*B21D 53/02* (2006.01)
*F28D 7/02* (2006.01)

(52) U.S. Cl.
CPC ..... *F28F 9/013* (2013.01); *B21D 53/027* (2013.01); *F28D 7/024* (2013.01); *F28F 9/0132* (2013.01); *F28F 2275/06* (2013.01); *F28F 2275/08* (2013.01)

(58) Field of Classification Search
CPC ..... F28F 9/0132; F28D 7/024; F22B 37/205
See application file for complete search history.

(56) References Cited

U.S. PATENT DOCUMENTS 3,083,447 A 4/1963 Andersen et al.
3,700,030 A 10/1972 Bosquain et al.
4,160,477 A * 7/1979 Roffler ..... G21C 3/3563 165/172
4,167,211 A 9/1979 Haller
(Continued)

FOREIGN PATENT DOCUMENTS

CN 107504840 A * 12/2017 ..... F28D 7/02
EP 2349600 A2 8/2011

*Primary Examiner* — Eric S Ruppert
(74) *Attorney, Agent, or Firm* — Millen White Zelano & Branigan, PC; Brion P. Heaney

(57) ABSTRACT

A heat exchanger, comprising: a tube bundle having at least one tube for receiving a fluid medium, wherein the at least one tube is wound about a core tube which extends along a longitudinal axis, and a first tube section of the at least one tube rests against at least one web which extends along the tube core and at least one first bracket element for securing the first tube section to the at least one web, the at least one first bracket element having a lower face which faces the first tube section and rests against the first tube section. The invention additionally relates to a securing system and to a method.

13 Claims, 6 Drawing Sheets

(56) References Cited

U.S. PATENT DOCUMENTS

| | | | | |
|---|---|---|---|---|
| 4,447,942 | A * | 5/1984 | Jabsen | F22B 37/205 165/172 |
| 2005/0109494 | A1 * | 5/2005 | Williams | F28F 9/0135 165/162 |
| 2010/0096115 | A1 * | 4/2010 | Erickson | F28F 9/0132 165/163 |
| 2018/0195807 | A1 | 7/2018 | Wickham et al. | |

* cited by examiner

SUPPORT OF HEAT EXCHANGERS MADE OF WOUND TUBES

The invention relates to a wound heat exchanger according to claim 1.

Such heat exchangers have a tube bundle having at least one or more tubes for receiving at least one fluid first medium, wherein the at least one tube is or the tubes are helically wound, at least in sections, around a core tube which extends along a longitudinal axis in a jacket space provided for receiving a second medium, wherein the at least one tube or tubes are wound on webs, which extend along the longitudinal axis of the core tube. Thereby, the tube bundle can have several tube layers, wherein a tube layer is supported via webs on a tube layer arranged thereunder or on the core tube. Thus, a plurality of adjacent tube sections rest against or on each web. Thereby, the tube sections can belong to a tube (in the case that the tube layer is wound only from one tube) or to various tubes which are wound next to one another in the relevant tube layer on the underlying tube layer.

Figure 1:
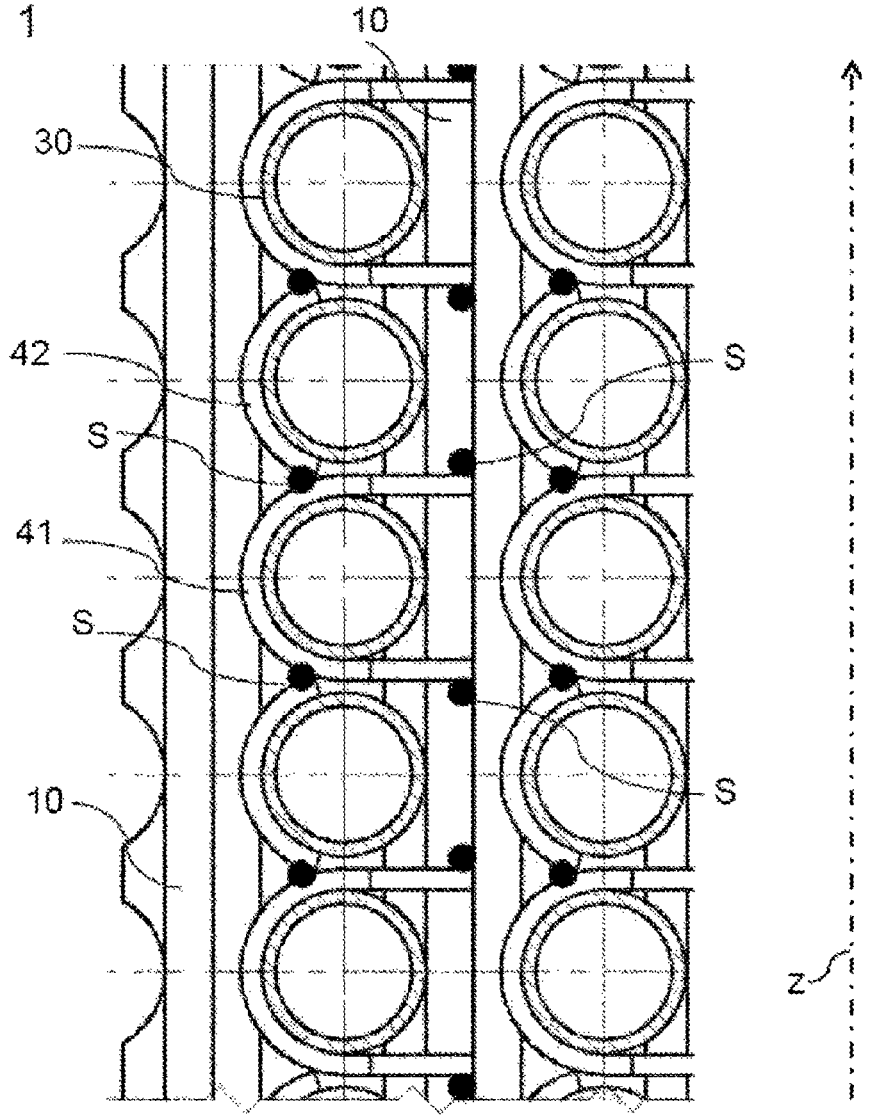

In the production of wound heat exchangers, in the manufacturing operation of the applicant, according to the configuration shown in FIG. 1, bracket elements 41, 42 (for example, made of sheet metal strips) have previously been slipped over the individual tube sections 30 resting against the webs 10 and connected at various points by means of welded connections S. Thereby, for example, first bracket elements 41 can be connected to the webs 10 by via welded connections S, whereas second bracket elements 42 arranged between adjacent first bracket elements 41 can be connected to the first bracket elements 41 via welded connections S. The tube sections 30 are thus fixed to the webs 10. The webs 10 of the next outer tube layer are placed on the bracket elements 41, 42. The adjacent or overlying tube sections 30 are then in turn fixed to these webs 10 in the same manner.

In the case of the welded connections S in the manner of FIG. 1, however, there is the risk of melting the tubes to be secured, and, in the case of materials having a small oxide layer, also the connection of the respective bracket element to the respective tube.

It should be noted, in particular, that as a result of the welding process, so much energy must be introduced locally that the metal melts. This high amount of energy is then dissipated to the surrounding parts by thermal conduction, such that the direct contact point reaches the melting temperature at the hottest point with favorable heat transfer coefficients. If, in addition, the tube wall thickness is still very thin, this region becomes larger, because there is not enough material to reduce this temperature through the heat capacity of the parts.

On the basis of this, the present invention is based upon the aim of providing a heat exchanger of the type mentioned at the outset which is improved with regard to the aforementioned problems.

This aim is achieved by a heat exchanger having the features of claim 1. Advantageous configurations of these aspects of the invention are specified in the respective dependent claims and are described below.

Further aspects of the invention relate to a securing system and a method for fixing a tube section to a web of a heat exchanger.

According to claim 1, a heat exchanger is provided, comprising:

a tube bundle having at least one tube for receiving a fluid medium, wherein the at least one tube is helically wound—in particular, at least in sections—around a core tube which extends along a longitudinal axis, wherein the at least one tube rests with a first tube section against at least one web (or rests on the web) which extends along the longitudinal axis, and at least one first bracket element for fixing the first tube section on the at least one web, wherein the bracket element rests with a lower face facing the first tube section against the first tube section, and wherein, according to the invention, the at least one first bracket element has at least one first securing region, which forms an elevation on an upper face, facing away from the lower face, of the at least one first bracket element, and which forms a depression on the lower face of the at least one first bracket element, such that, in particular, the at least one first bracket element together with the first tube section encloses the depression, which serves, in particular, for thermal insulation during the production of a welded connection between the at least one first securing region and an additional bracket element or a web.

According to one embodiment of the invention, it is provided that the heat exchanger have a jacket which defines a jacket space in which the tube bundle and the core tube are arranged. The jacket space is formed to accommodate an additional fluid medium, such that the fluid medium guided in the tube bundle and the additional fluid medium accommodated in the jacket space can enter into an indirect heat exchange. Such heat exchangers with tube bundles of wound tubes are also referred to as wound heat exchangers.

Within the framework of the present invention, the bracket elements can, furthermore, be manufactured from a metal—in particular, from a metal strip—wherein the securing regions (for example, in the form of beads) are embossed in such a manner that the bracket element forms a depression or a cavity on the inner side.

Due to the configuration of the securing regions (enclosing a depression or a corresponding cavity with the respective tube section), the location of the energy introduction is further away from the respective tube section in terms of heat conduction, and the relevant tube section is thus no longer in contact with the weld pool produced during welding.

Due to the transient heat conduction after the welding process, it is now no longer possible to achieve melting temperatures on the tube. Due to the larger paths of the heat, on the one hand, heat is temporarily stored, and, on the other, the temperature at the contact point to the tube is reduced due to a temperature gradient. Melting, or even a connection of the respective bracket element to the respective tube, can thereby be ruled out.

According to one embodiment of the heat exchanger according to the invention, it is provided that the elevation formed by the first securing region be convexly curved, and/or that the depression formed by the first securing region be concavely curved.

Furthermore, according to one embodiment of the heat exchanger according to the invention, it is provided that the at least one first securing region (or the elevation/depression) be embossed into the at least one first bracket element by shaping the at least one first bracket element (in particular, deep drawing).

The at least one first securing region is thus embodied, in particular, in the form of a bead and protrudes on the upper face of the at least one first bracket element, whereas the at least one first securing region forms a corresponding depression or dent on the lower face.

Furthermore, according to one embodiment of the heat exchanger according to the invention, it is provided that the at least one first securing region of the at least one first bracket element be welded to an additional bracket element or to an additional web via a welded connection.

Furthermore, according to one embodiment of the heat exchanger according to the invention, it is provided that the at least one first bracket element have a first end section and an opposite second end section, wherein the two end sections are connected to one another via a curved middle section of the at least one first bracket element. Thereby, it is provided in particular that the middle section rest against the first tube section, wherein, in particular, the first end section is further connected to the at least one web via a welded connection, and wherein, in particular, the second end section is further connected to the at least one web via a welded connection.

Furthermore, according to one embodiment of the heat exchanger according to the invention, it is provided that the middle section be curved in a circumferential direction of the first tube section, such that the inner side of the at least one first bracket element in the region of the middle section rests flat—in particular, in a positive-locking manner—on an upper face, facing away from the web, of the first tube section. In other words, the middle section of the at least one first bracket element forms a—for example—half-cylindrical shell for resting against the upper face of the first tube section.

Thereby, according to one embodiment, the two end sections of the at least one first bracket element protrude from the middle section in the direction of the at least one web (in particular, in each case, tangentially to the surface of the tube section), such that the two end sections run parallel to one another (on sides of the tube section facing away from one another). The at least one first bracket element thus surrounds the first tube section together with the at least one web on which the first tube section rests.

Furthermore, according to one embodiment of the heat exchanger according to the invention, it is provided that the at least one first securing region of the at least one first bracket element be formed on the middle section of the at least one first bracket element and be connected to a first end section of a second bracket element via a welded connection.

Furthermore, according to one embodiment of the heat exchanger according to the invention, it is provided that the at least one first bracket element have a second securing region, which forms an elevation on the upper face of the at least one first bracket element, and which forms a depression on the lower face of the at least one first bracket element, such that the first bracket element together with the first tube section forms this depression. Furthermore, the second securing region is formed in particular on the middle section of the at least one first bracket element and is opposite the first securing region—in particular, in a circumferential direction of the tube section. Furthermore, the second securing region is connected in particular to a first end section of a third bracket element via a welded connection.

Furthermore, according to one embodiment of the heat exchanger according to the invention, it is provided that the middle section of the at least one first bracket element be wider in an axial direction of the first tube section than the two end sections of the at least one first bracket element, and/or that the middle section of the at least one first bracket element have a greater length in the axial direction than in a circumferential direction of the first tube section, and/or that the middle section of the at least one first bracket element be wider in the axial direction than the at least one web.

This facilitates in particular the fixing of the webs of the next outer tube layer. Such webs can be laid on the bracket elements and can then be connected to the third and fourth securing regions of the first bracket elements via welded connections (see below).

Furthermore, according to one embodiment of the heat exchanger according to the invention, it is provided that, on the middle section of the at least one first bracket element, a third securing region be provided, which forms an elevation on the upper face of the at least one first bracket element, and which forms a depression on the lower face of the at least one first bracket element, such that the first bracket element together with the first tube section forms this depression, wherein the third securing region is connected to an additional web of the tube bundle of the heat exchanger via a welded connection.

Furthermore, according to one embodiment of the heat exchanger according to the invention, it is provided that, on the middle section of the at least one first bracket element, a fourth securing region be provided, which forms an elevation on the upper face of the at least one first bracket element, and which forms a depression on the lower face of the at least one first bracket element, such that the first bracket element together with the first tube section encloses this depression, wherein the fourth securing region is opposite the third securing region in an axial direction of the first tube section, and wherein the fourth securing region is connected to the additional web of the tube bundle of the heat exchanger via a welded connection.

The specified additional web runs, in particular, parallel to the at least one web and rests against the middle section of the at least one first bracket element (and, optionally, on the additional bracket elements). The first tube section and adjacent tube sections of the same tube layer are correspondingly arranged between the at least one web and the additional web.

Furthermore, according to one embodiment of the heat exchanger according to the invention, it is provided that the first and the second securing regions be arranged in an axial direction between the third and the fourth securing regions on the middle section of the at least one first bracket element.

Furthermore, according to one embodiment of the heat exchanger according to the invention, it is provided that the middle section of the at least one first bracket element have a first and a second passage opening, such that the middle section resting against the first tube section leaves a first and a second surface region of the first tube section free, wherein the additional web rests, with a first base, on the first surface region and, with a second base, on the second surface region of the tube section. The passage openings thus make possible a contact of the additional web with the underlying tubes or tube sections, wherein the additional web with its bases engages in the associated passage openings and can accordingly be supported on the tube sections.

Furthermore, according to one embodiment of the heat exchanger according to the invention, it is provided that the two passage openings of the middle section of the at least one first bracket element be opposite one another in the axial direction of the first tube section, wherein the two passage openings are arranged in the axial direction between the third and fourth securing regions of the middle section of the at least one first bracket element, and wherein the first and second securing regions are arranged in the axial direction between the two passage openings on the middle section of the at least one first bracket element.

Furthermore, according to one embodiment of the heat exchanger according to the invention, a second bracket element is provided, which serves to fix a second tube section of a tube of the tube bundle, which runs adjacently to the first tube section and rests against the at least one web. Thereby, it is provided according to one embodiment of the invention that the second bracket element rest with a lower face facing the second tube section against the second tube section. Furthermore, according to one embodiment, it is provided that the second bracket element have a first end section and an opposite second end section, wherein the two end sections of the second bracket element are connected to one another via, in particular, a middle section of the second bracket element, and wherein, in particular, the middle section of the second bracket element rests against the second tube section. Furthermore, according to one embodiment, it is provided that the first end section of the second bracket element be connected to the first securing region of the at least one first bracket element via a welded connection, and/or that the second end section of the second bracket element be connected to the web via a welded connection.

Furthermore, according to one embodiment of the heat exchanger according to the invention, it is provided that the middle section of the second bracket element be curved in a circumferential direction of the second tube section, such that the inner side of the second bracket element in the region of the middle section of the second bracket element rests flat—in particular, in a positive-locking manner—on an upper face, facing away from the web, of the second tube section. In other words, the middle section of the second bracket element forms a shell for resting against the upper face of the second tube section.

Thereby, the second end section of the second bracket element according to one embodiment protrudes from the middle section of the second bracket element—in particular, tangentially to the surface of the second tube section—whereas the first end section of the second bracket element protrudes from the middle section of the second bracket element—in particular, in a direction away from the second tube section—and thereby extends in the direction of the first securing region of the at least one first bracket element, to which the first end section of the second bracket element is connected via a welded connection.

The second bracket element thus encloses the second tube section together with the web and the first end section of the at least one first bracket element.

Furthermore, according to one embodiment of the heat exchanger according to the invention, it is provided that the second bracket element have, in its middle section, a securing region, which forms an elevation on an upper face, facing away from the lower face, of the second bracket element, and which forms a depression on the lower face of the second bracket element, such that the second bracket element together with the second tube section forms this depression. Thereby, it is provided in particular that the securing region of the second bracket element be connected to an additional third bracket element via a welded connection (see below).

Furthermore, according to one embodiment of the heat exchanger according to the invention, a third bracket element is provided, which is provided for fixing a third tube section of a tube of the tube bundle, which runs adjacently to the second tube section (the second tube section extends between the first and the third tube sections) and rests against the at least one web. Thereby, according to one embodiment, the third bracket element rests with a lower face, facing the third tube section, of the third bracket element against the third tube section. Furthermore, according to one embodiment, it is provided that the third bracket element have a first end section and an opposite second end section, wherein the two end sections of the third bracket element are connected to one another via a middle section of the third bracket element, wherein, in particular, the middle section of the third bracket element rests against the third tube section. Furthermore, according to one embodiment, it is provided that the first end section of the third bracket element be connected to the securing region of the second bracket element via a welded connection, and/or that the second end section of the third bracket element be connected to a second securing region of an additional first bracket element via a welded connection.

Furthermore, according to one embodiment of the heat exchanger according to the invention, it is provided that the middle section of the third bracket element be curved in a circumferential direction of the third tube section, such that the inner side of the third bracket element in the region of the middle section of the third bracket element rests flat—in particular, in a positive-locking manner—on an upper face, facing away from the web, of the third tube section. In other words, the middle section of the third bracket element in turn forms a shell for resting against the upper face of the third tube section.

Thereby, according to one embodiment, the first end section of the third bracket element protrudes from the middle section of the third bracket element in a direction away from the third tube section and thereby extends in the direction of the securing region of the second bracket element, to which the first end section of the third bracket element is connected via a welded connection.

Furthermore, according to one embodiment of the heat exchanger according to the invention, it is provided that the second end section of the third bracket element protrude from the middle section of the third bracket element in a direction away from the third tube section and thereby extend in particular in the direction of the second securing region of the additional second bracket element, to which the second end section of the third bracket element is connected—in particular, via a welded connection.

The invention has been described above in connection with a wound heat exchanger. An additional aspect of the present invention relates to a securing system for fixing at least one first tube section to a web—in particular, a tube section of a tube bundle of a wound heat exchanger to a web of the tube bundle. The securing system according to the invention thereby has at least: a first bracket element, which is formed to be placed with a lower face facing the first tube section against the first tube section, wherein the first bracket element has a first securing region, which forms an elevation on an upper face, facing away from the lower face, of the at least one first bracket element, and which forms a depression on the lower face of the at least one first bracket element, such that the first bracket element, when resting against the upper face of the first tube section, together with the first tube section encloses this depression as a cavity.

Furthermore, according to one embodiment of the securing system according to the invention, it is provided that the first securing region be formed to be connected to an additional bracket element or an additional web via a welded connection.

Due to the specified cavity or depression, the tube section is protected by an excessive effect of heat during the production of the welded connection (see also above).

Furthermore, according to one embodiment of the securing system according to the invention, it is provided that the elevation be curved convexly and/or that the depression be curved concavely (see above).

Furthermore, according to one embodiment of the securing system according to the invention, it is provided that the first bracket element have a first end section and an opposite second end section, wherein the two end sections are connected to one another via a curved middle section of the first bracket element, wherein the inner side of the first bracket element is formed in the region of the middle section for resting against the first tube section.

Furthermore, according to one embodiment of the securing system according to the invention, it is provided that the middle section of the first bracket element be curved, such that the inner side of the first bracket element in the region of the middle section can rest flat—in particular, in a positive-locking manner—on an upper face, facing away from the web, of the first tube section, wherein, in particular, the two end sections run parallel to one another.

Furthermore, according to one embodiment of the securing system according to the invention, it is provided that the first end section of the first bracket element protrude from the middle section of the first bracket element in such a manner that it is arranged on the web—in particular, rests against it—if the first bracket element rests with its lower face or its middle section against the first tube section, and the first tube section rests against the web. As a result, the first end section of the second bracket element can be connected to the web via a (in particular, point-shaped) welded connection.

Furthermore, according to one embodiment of the securing system according to the invention, it is provided that the second end section of the first bracket element protrude from the middle section of the first bracket element in such a manner that it is arranged on the web—in particular, rests against it—if the first bracket element rests with its lower face or its middle section against the first tube section and if the first tube section rests against the web. As a result, the second end section of the second bracket element can also be connected to the web via a (in particular, point-shaped) welded connection.

Furthermore, according to one embodiment of the securing system according to the invention, it is provided that the first securing region of the first bracket element be formed on the middle section of the first bracket element.

Furthermore, according to one embodiment of the securing system according to the invention, it is provided that the first securing region be formed to be connected to a first end section of a second bracket element via a welded connection.

Furthermore, according to one embodiment of the securing system according to the invention, it is provided that the first bracket element have a second securing region, which forms an elevation on the upper face of the first bracket element, and which forms a depression on the lower face of the first bracket element, such that the first bracket element, when resting against the upper face of the first tube section, encloses this depression together with the first tube section.

Furthermore, according to one embodiment of the securing system according to the invention, it is provided that the second securing region of the first bracket element be formed to be connected to a second end section of a third bracket element via a welded connection.

According to one embodiment of the securing system according to the invention, the second securing region is likewise formed on the middle section of the first bracket element and lies, in particular, opposite the first securing region—specifically, in a circumferential direction of the first tube section—if the first bracket element rests with its lower face or its middle section against the first tube section.

Furthermore, according to one embodiment of the securing system according to the invention, it is provided that the middle section of the first bracket element be wider in a first direction than the two therewith connected end sections of the first bracket element. In an additional embodiment of the securing system according to the invention, it is provided that the middle section of the first bracket element have a greater length in the first direction than in a second direction perpendicular thereto, wherein, if the first bracket element rests with its inner side or its middle section against the first tube section, the first direction corresponds to the axial direction of the first tube section, and the second direction corresponds to the circumferential direction of the first tube section.

Furthermore, according to one embodiment of the securing system according to the invention, it is provided that, on the middle section of the first bracket element, a third securing region be provided, which forms an elevation on the upper face of the first bracket element, and which forms a depression on the lower face of the first bracket element, such that the first bracket element, when resting against the upper face of the first tube section, encloses this depression together with the first tube section.

Furthermore, according to one embodiment of the securing system according to the invention, it is provided that the third securing region be formed to be connected to an additional web (in particular, an additional web of the tube bundle of the heat exchanger) via a welded connection, if the additional web is arranged parallel to the one web on the first bracket element.

Furthermore, according to one embodiment of the securing system according to the invention, it is provided that, on the middle section of the first bracket element, a fourth securing region be provided, which forms an elevation on the upper face of the first bracket element, and which forms a depression on the lower face of the first bracket element, such that the first bracket element, when resting against the upper face of the first tube section, encloses this depression together with the first tube section.

Furthermore, according to one embodiment of the securing system according to the invention, it is provided that the fourth securing region be formed to be connected to the additional web of the tube bundle of the heat exchanger via a welded connection, if the additional web is arranged parallel to the one web on the first bracket element.

Furthermore, according to one embodiment of the securing system according to the invention, it is provided that the first and the second securing regions of the first bracket element be arranged in the first direction between the third and the fourth securing regions on the middle section of the first bracket element.

Furthermore, according to one embodiment of the securing system according to the invention, it is provided that the middle section of the first bracket element have a first and a second passage opening, such that, in the case of a middle section, resting against the first tube section, of the first bracket element, a first and a second surface region of the first tube section are left free, and, in particular, the additional web, with a first base, can be positioned on the first surface region and, with a second base, on the second surface region of the tube section.

Furthermore, according to one embodiment of the securing system according to the invention, it is provided that the two passage openings be situated opposite one another in the first direction, wherein the two passage openings are arranged in the first direction between the third and the fourth securing regions, and wherein the first and second securing regions are arranged in the first direction between the two passage openings on the middle section of the first bracket element.

Furthermore, according to one embodiment of the securing system according to the invention, it is provided that the securing system have a second bracket element that, for fixing a second tube section of a tube of the tube bundle, which runs adjacently to the first tube section and rests against the at least one web, is formed to rest with a lower face facing the second tube section against the second tube section.

Furthermore, according to one embodiment of the securing system according to the invention, it is provided that the second bracket element have a first end section and an opposite second end section, wherein the two end sections of the second bracket element are connected to one another via a curved middle section of the second bracket element, wherein, in particular, the inner side of the second bracket element is formed in the region of the middle section for resting against the second tube section.

Furthermore, according to one embodiment of the securing system according to the invention, it is provided that the second bracket element be formed such that the first end section of the second bracket element comes to rest adjacent to the first securing region of the first bracket element, if the first bracket element rests with its lower face or its middle section against the first tube section and if the second bracket element rests with its lower face or its middle section against the second tube section. As a result, the first securing region of the first bracket element can be connected to the first end section of the second bracket element via, in particular, a welded connection.

Furthermore, according to one embodiment of the securing system according to the invention, it is provided that the second end section of the second bracket element protrude from the middle section of the second bracket element in such a manner that it is arranged on the web—in particular, rests against it—if the second bracket element rests with its lower face or its middle section against the second tube section and if the second tube section rests against the web. As a result, the second end section of the second bracket element can be connected to the web—in particular, via a welded connection.

In contrast, according to one embodiment of the securing system according to the invention, the first end section of the second bracket element protrudes from the middle section of the second bracket element in a direction away from the second tube section and thereby extends in the direction of the first securing region of the first bracket element, if the first bracket element rests with its lower face or its middle section against the first tube section, and if the second bracket element rests with its lower face or its middle section against the second tube section.

Furthermore, according to one embodiment of the securing system according to the invention, it is provided that the second bracket element have, in its middle section, a securing region, which forms an elevation on an upper face, facing away from the lower face, of the second bracket element, and which forms a depression on the lower face of the second bracket element, such that the second bracket element, when resting against the upper face of the second tube section, encloses this depression together with the first tube section.

Furthermore, according to one embodiment of the securing system according to the invention, it is provided that the securing region of the second bracket element be formed to be connected to an end section of a third bracket element via a welded connection (see below).

Furthermore, according to one embodiment of the securing system according to the invention, it is provided that the securing system have a third bracket element that, for fixing a third tube section of a tube of the tube bundle, which runs adjacently to the second tube section and rests against the web, is formed to rest with a lower face, facing the third tube section, against the third tube section. The second tube section is thus arranged between the first and third tube sections.

Furthermore, according to one embodiment of the securing system according to the invention, it is provided that the third bracket element have a first end section and an opposite second end section, wherein the two end sections of the third bracket element are connected to one another via a curved middle section of the third bracket element, wherein, in particular, the lower face in the region of the middle section of the third bracket element is formed to rest against the third tube section.

Furthermore, according to one embodiment of the securing system according to the invention, it is provided that the third bracket element be formed such that the first end section of the third bracket element comes to rest adjacent to the securing region of the second bracket element, if the second bracket element rests with its lower face or its middle section against the second tube section and if the third bracket element rests with its lower face or its middle section against the third tube section. As a result, the securing region of the second bracket element can be connected to the first end section of the third bracket element via a welded connection.

Furthermore, according to one embodiment of the securing system according to the invention, it is provided that the third bracket element be formed such that the second end section of the third bracket element comes to rest adjacent to a second securing region of an additional first bracket element, if the additional first bracket element rests with its lower face or its middle section against an additional first tube section, which runs adjacently to the third tube section, and if the third bracket element rests with its lower face or its middle section against the third tube section. As a result, the second securing region of the additional first bracket element can be connected to the second end section of the third bracket element via a welded connection.

Furthermore, according to one embodiment of the securing system according to the invention, it is provided that the first end section of the third bracket element protrude from the middle section of the third bracket element in a direction away from the third tube section and thereby extend in the direction of the securing region of the second bracket element, if the second bracket element rests with its lower face or its middle section against the second tube section, and if the third bracket element rests with its lower face or its middle section against the third tube section.

Furthermore, according to one embodiment of the securing system according to the invention, it is provided that the second end section of the third bracket element protrude from the middle section of the third bracket element in a direction away from the third tube section and thereby extend in the direction of the second securing region of the additional first bracket element, if the third bracket element rests with its lower face or its middle section against the third tube section and if the additional first bracket element rests with its lower face or its middle section against the additional first tube section, which runs adjacently to the third tube section.

In particular, the third bracket element has no raised securing regions in its middle section.

Furthermore, according to one embodiment of the securing system according to the invention, it is provided that the securing system have a plurality of first, second, and third bracket elements, which are formed to fix a corresponding plurality of adjacent tube sections, which rest against a web of a tube bundle of the heat exchanger, to the web, wherein a second and a third bracket element are arranged between each two adjacent first bracket elements, wherein the bracket elements are—in particular, in the manner described above—connected to one another and to the web.

An additional aspect of the present invention relates to a method for fixing at least one first tube section of a tube bundle of a heat exchanger to a web of the tube bundle using a securing system according to the invention, wherein a first tube section is placed against the web, and the first bracket element is placed with its lower face (in particular, in the region of the middle section of the first bracket element) against the first tube section, wherein the two end sections of the first bracket element are connected to the web via a welded connection in each case.

Furthermore, according to one embodiment of the method according to the invention, it is provided that a second tube section adjacent to the first tube section be placed against the web, and that, in particular, a third tube section adjacent to the second tube section be placed against the web.

Furthermore, according to one embodiment of the method according to the invention, it is provided that the second bracket element with its lower face or its middle section be placed against the second tube section, which runs adjacently to the first tube section, such that the first end section of the second bracket element is arranged on the first securing region of the first bracket element, and such that the second end section of the second bracket element is arranged on the web.

Furthermore, according to one embodiment of the method according to the invention, it is provided that the third bracket element with its lower face or its middle section be placed against a third tube section, which runs adjacently to the second tube section, such that the first end section of the third bracket element is arranged on the securing region of the second bracket element, and such that, in particular, the second end section of the third bracket element is arranged on a second securing region of an additional first bracket element.

Furthermore, according to one embodiment of the method according to the invention, it is provided that the first securing region of the first bracket element be connected to the first end section of the second bracket element via a welded connection.

Furthermore, according to one embodiment of the method according to the invention, it is provided that the securing region of the second securing bracket be connected to the first end section of the third securing bracket via a welded connection.

Furthermore, according to one embodiment of the method according to the invention, it is provided that the second end section of the second securing bracket be connected to the web via a welded connection.

Furthermore, according to one embodiment of the method according to the invention, it is provided that the second end section of the third securing bracket be connected to the second securing region of the additional first securing bracket via a welded connection.

Furthermore, according to one embodiment of the method according to the invention, it is provided that an additional web be arranged on the first, second, and third securing brackets, such that the additional web rests, with a first base, against the first surface region of the first tube section, and such that the additional web, with the second base, rests against the second surface region of the first tube section.

Furthermore, according to one embodiment of the method according to the invention, it is provided that the third securing region of the first securing bracket be connected to the additional web via a welded connection.

Furthermore, according to one embodiment of the method according to the invention, it is provided that the fourth securing region of the first securing bracket be connected to the additional web via a welded connection.

With the method according to the invention, a plurality of tube sections adjacent to one another on a web can be fixed to the web by means of the first, second, and third securing brackets, wherein, particularly between two adjacent first securing brackets, a second and a third securing bracket are arranged on the respective (second or third) tube section.

In the event that the tube sections are arranged one above the other in several tube layers in the radial direction of the tube bundle, the webs (which the respective tube sections of a tube layer rest against or on) in each case rest against the securing brackets of the underlying tube layer and are welded thereto (via the third and fourth securing regions of the first securing brackets).

Figure 2:
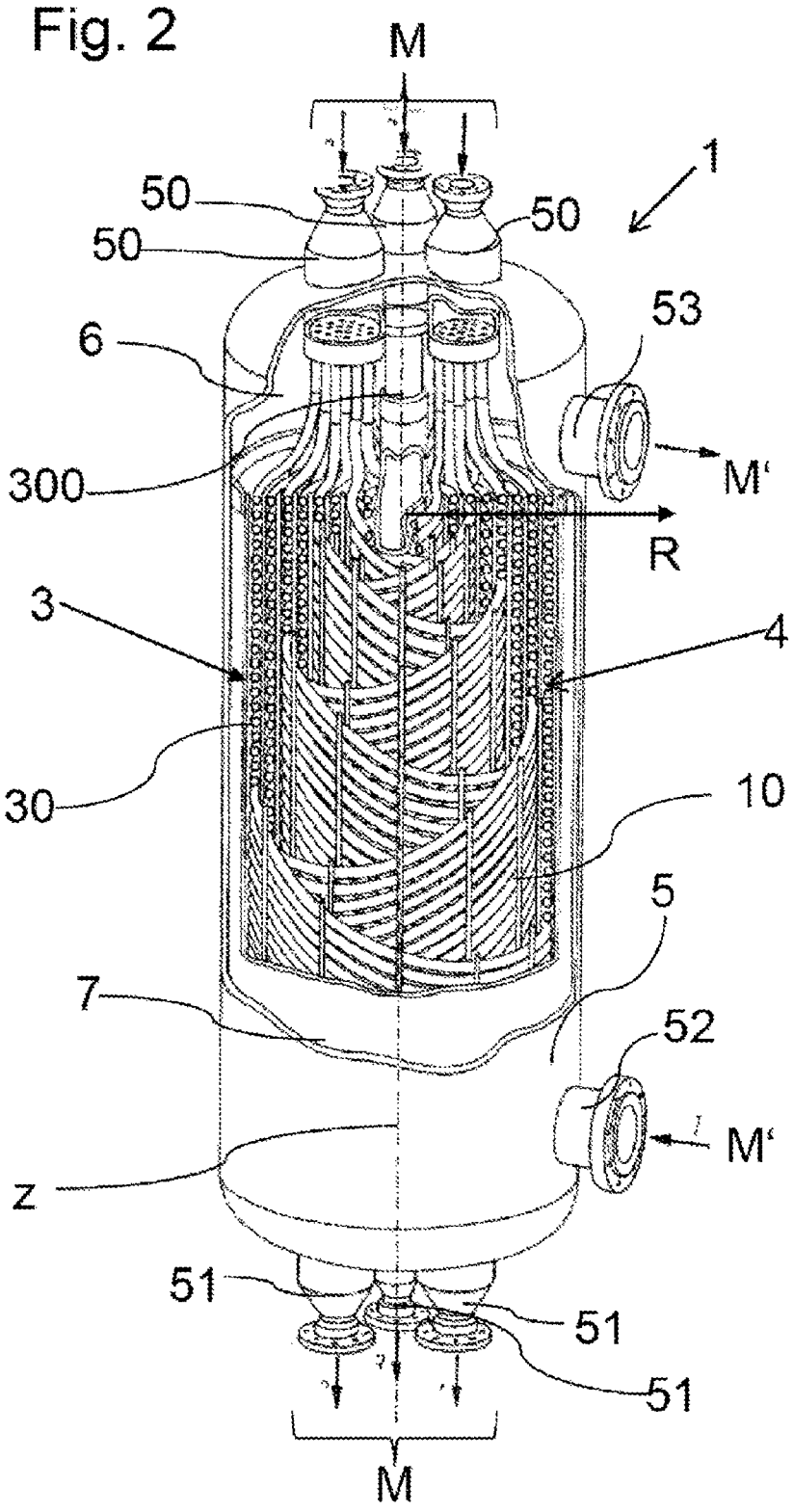
Figure 3:
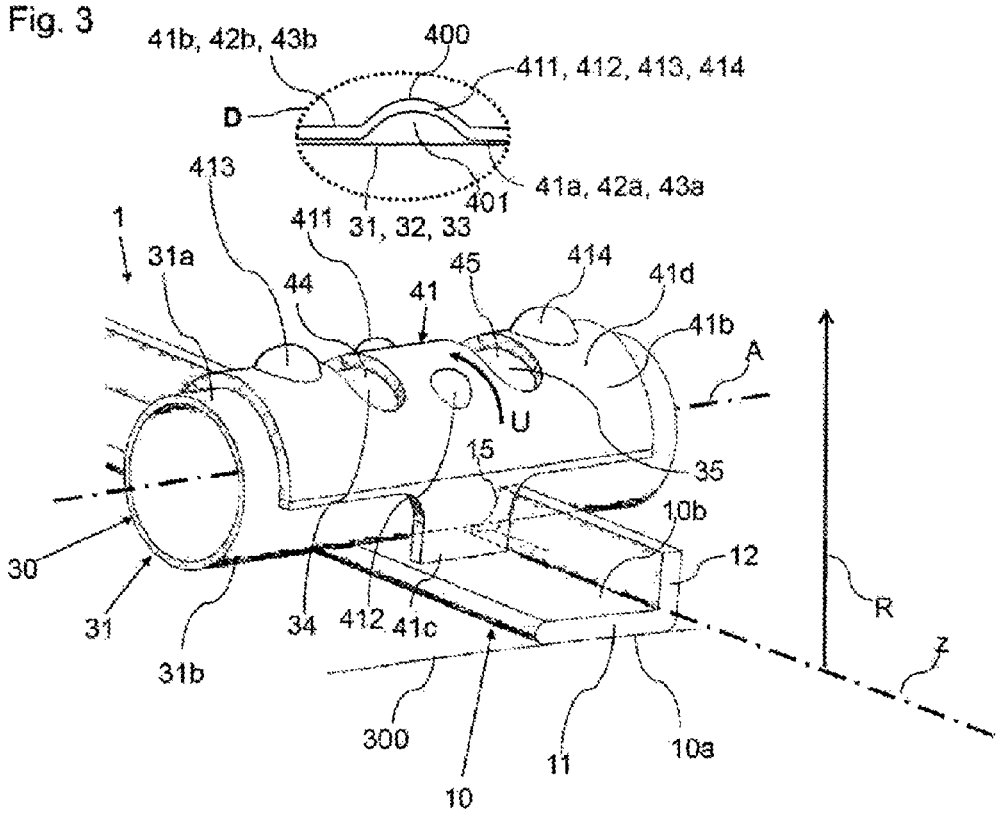
Figure 4:
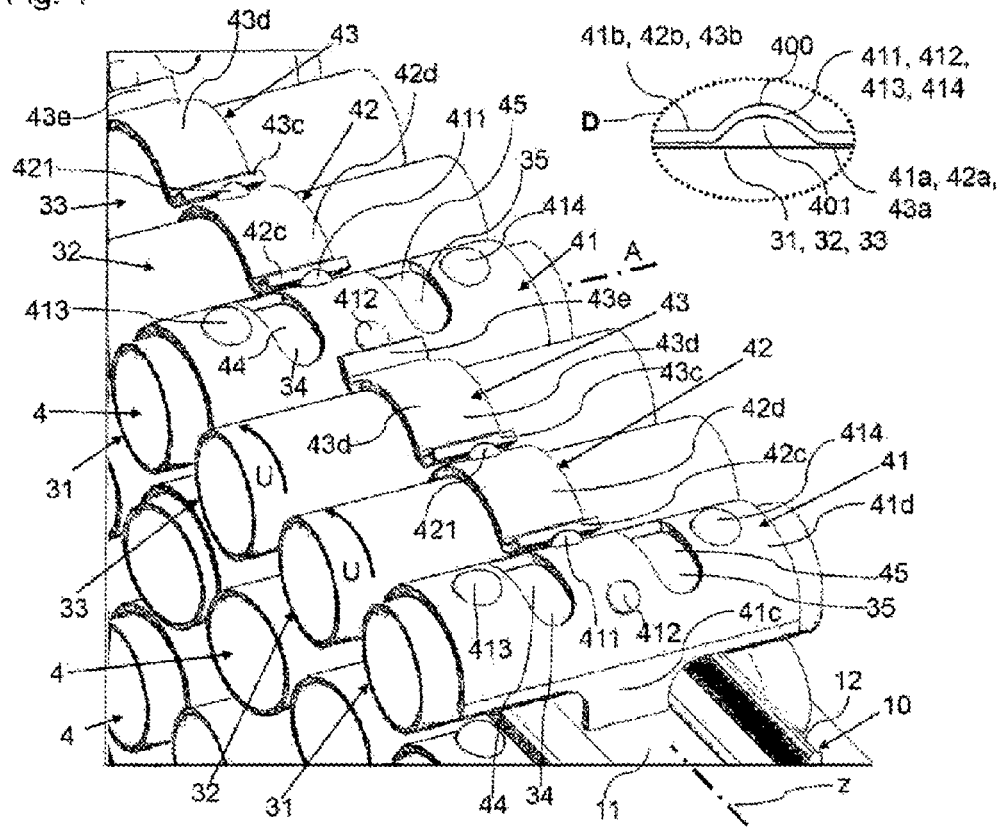
Figure 5:
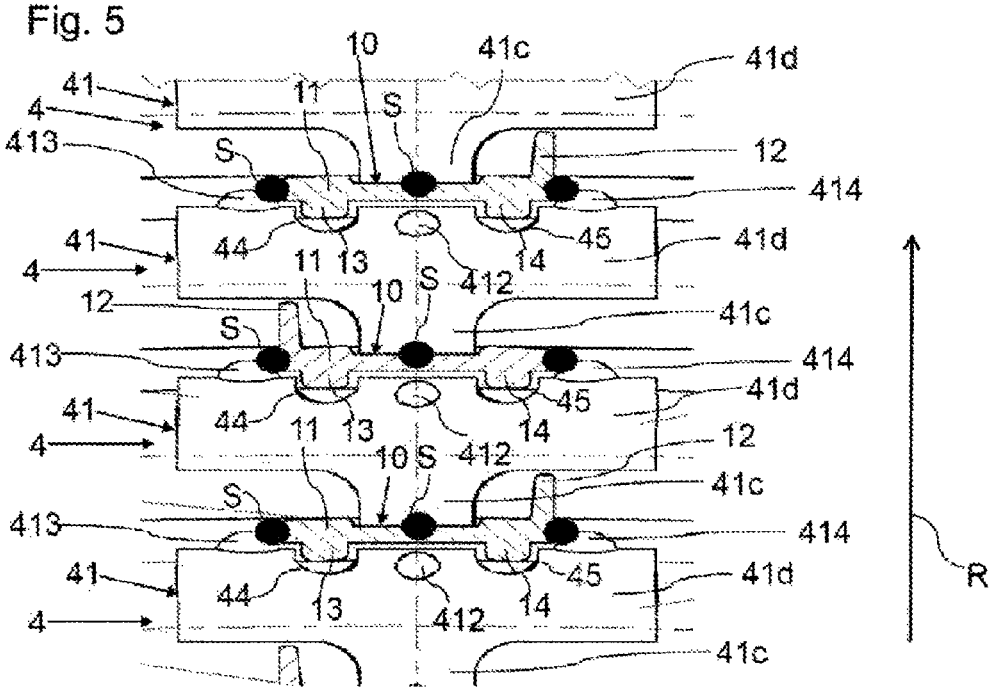
Figure 6:
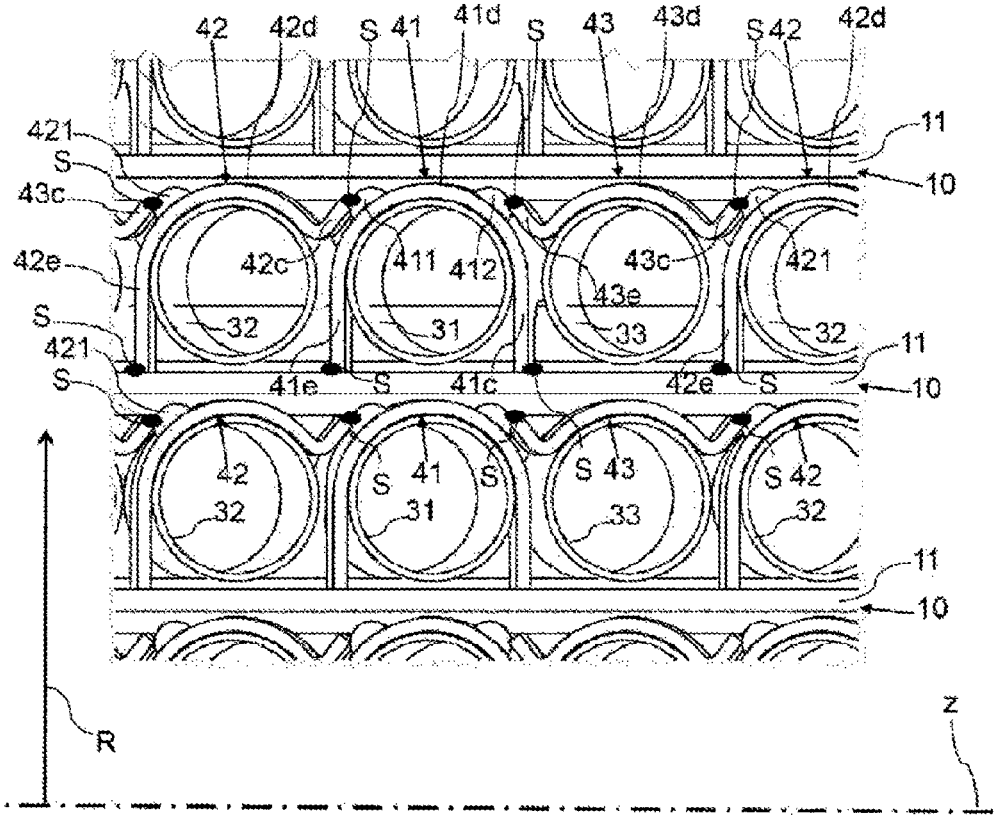

Further details and advantages of the invention shall be explained by the following description of figures of an exemplary embodiment with reference to the figures. The following are shown:

FIG. 1 a securing of tube sections of a tube bundle to webs of the tube bundle by means of securing brackets according to one design which has been customary in the manufacturing plant of the applicant up to now;

FIG. 2 a cutaway sectional view of an example of a heat exchanger according to the invention;

FIG. 3 a perspectival view of a first securing bracket of a securing system according to the invention;

FIG. 4 a perspectival view of a plurality of tube sections of a tube bundle of a wound heat exchanger (for example, in the manner of FIG. 2), wherein the tube sections are fixed to the webs of the tube bundle by means of first, second, and third securing brackets according to the invention;

FIG. 5 a partially cut side view of several first bracket elements according to FIG. 3 arranged one above the other in the radial direction of the tube bundle; and FIG. 6 a sectional view of the tube bundle of a heat exchanger according to the invention, wherein the welded connections between the securing brackets are shown.

FIG. 2 shows an embodiment of a wound heat exchanger 1 according to the invention in connection with FIG. 3.

The heat exchanger 1 has a tube bundle 3 which is shown by way of example in FIG. 2 in a perspectival and partially cut view.

The tube bundle 3 can thereby have several tubes 30 for receiving at least one second fluid medium M, wherein, according to FIG. 2, the tubes 30 are wound—in particular, helically—onto the core tube 300 of the heat exchanger 1, which extends along the longitudinal axis z, such that the tube bundle 3 has several tube layers 4, which are arranged one above the other in the radial direction R of the tube bundle 3. Thereby, the respective radial direction R is perpendicular to the longitudinal axis z and points away from it or outwards.

According to FIG. 2, the tube bundle 3 is surrounded by a cylindrically-shaped shell 5, which delimits a jacket space 6 in which the tube bundle 3 is arranged together with the core tube 300. For example, a second medium M' can be introduced into the jacket space 6 via a connecting piece 52 and can be removed from the jacket space 6 via an additional connecting piece 53, such that the at least one first medium M and the second medium M' can exchange heat indirectly with one another. It is possible to divide the tubes 30 into several tube groups (three tube groups are shown in FIG. 2, for example) which can also be charged, for example, with different first media M. In order to introduce the at least one first medium M into the tubes 30 of the tube bundle 30, the heat exchanger 1 has at least one connecting piece 50. The at least one first medium M can be withdrawn again from the tube bundle 3 via at least one additional connecting piece 51. Furthermore, the tube bundle 3 can be surrounded by a cylindrical shroud 7, which serves to suppress a bypass flow in the jacket space 6 past the tube bundle 3.

As is further illustrated in FIG. 2, an, in particular, constant plurality of webs 10 is in each case provided—in particular, between an innermost tube layer 4 of the tube bundle 3 and the core tube 300, as well as between each two tube layers 4, adjacent in the radial direction R, of the tube bundle 3—in the circumferential direction of the tube layers 4 (i.e., between each two adjacent tube layers 4, the same number of webs 10 is provided), wherein the webs 10 each extend along the longitudinal axis z and are arranged one above the other in the radial direction R.

Thereby, the respective web 10 according to FIG. 3 has an upper face 10*a* facing away from the core tube 300 and a lower face 10*b* facing away from the upper face, which lower face faces the core tube 300 in each case. A plurality of concave recesses 15 is provided on the upper face 10*a* of the respective web 10 (FIG. 3 shows only one recess 15), which recesses are arranged equidistantly from one another—in particular, along the respective web 10. These recesses 15 are formed in a second leg 12, extending along the longitudinal axis z, of the respective web 10, which protrudes from a first leg 11, extending along the longitudinal axis z, in the radial direction R of the tube bundle 3. In the respective recess 15, a tube section of a wound tube is arranged in each case, which is designated in FIG. 3 as the first tube section 31. FIG. 4 shows in this regard several adjacent tube sections 31, 32, 33, which are arranged next to one another along the longitudinal axis z. The individual adjacent tube sections 31, 32, 33 may belong to a wound tube 30 or to different tubes 30, which are wound in a tube layer 4 onto the core tube 300. The respective tube sections 31, 32, 33 protrude from the respective recess 15 in the radial direction R of the tube bundle 3.

In order to protect the tube bundle 3 as well as possible during winding, the webs 10 extend over the entire length of the tube bundle 3 in the direction of the longitudinal axis z. Thereby, two webs 10 adjacent in the radial direction R are also connected to one another—in particular, over their entire length along the longitudinal axis z—at, in particular, regular intervals via the first bracket elements 41, which are described further below.

According to the invention, it is provided (cf., in particular, FIG. 3) that these first securing brackets 41, which are shown in FIGS. 3 through 6, serve for fixing in each case a first tube section 31 of the tube bundle 3 to an associated underlying web 10 of the tube bundle 3, wherein the at least one first bracket element 41 rests with a lower face 41*a* facing the first tube section 31 against the first tube section 31, and wherein the at least one first bracket element 41 has at least one first securing region 411 which, according to detail D of FIG. 3 or 4, forms an elevation 400 on an upper face 41*b*, facing away from the lower face 41*a*, of the at least one first bracket element 41, and which forms a depression 401 on the lower face 41*a* of the at least one first bracket element 41.

The additional securing regions 412, 413, 414, 421 described further below also have this structure shown in detail D.

Due to the formation of the first securing region 411, a welded connection S can be produced between the first securing region 411 and, for example, an additional bracket element, wherein heat generated during welding is kept away from the first tube section 31 due to the depression 401. The risk of damage to the tube section 31 due to the welding is thereby considerably reduced.

In addition to the at least one first bracket element 41, the heat exchanger 1 or the securing system according to the invention has, according to one embodiment, at least one second bracket element 42 along with, according to an additional embodiment, at least one third bracket element 43.

As shown in FIGS. 4 through 6, the first, second, and third bracket elements 41, 42, 43 are alternately arranged next to one another along the longitudinal axis z of the heat exchanger or of the tube bundle 3—preferably over the entire length of the tube bundle 3—and are connected to one another and to the webs 10, adjacent in the radial direction R, of the tube bundle 3 with welded connections S. The welded connections S between the individual bracket elements 41, 42, 43 and between bracket elements 41, 42 and the webs 10 are shown, in particular, in FIGS. 5 and 6.

The connections of the bracket elements 41, 42, 43 among one another and to two webs 10 adjacent in the radial direction R shall be described below for a tube layer 4 of the tube bundle 3 and apply in particular to all tube layers 4 and webs 10 of the tube bundle 3.

When the tube bundle 3 is wound, the individual tubes 30 are wound around the core tube 300, wherein the tube or tubes 30 of a tube layer 3 are each wound on webs 10, which are arranged on the core tube 300 or are arranged and secured on the last wound tube layer 4. When the tube or tubes 30 are wound, tube sections 31, 32, 33 of adjacent windings come to lie on a web 10—as already explained above—which windings then rest next to one another against the web 10 along the longitudinal axis z and thereby engage in the recesses 15 of the web 10 under consideration.

Thereby, the three tube sections 31, 32, 32, which are fixed to the web 10 with a first, a second, and a third bracket element 41, 42, 43, are referred to as first, second, and third tube sections 31, 32, 33. According to this, the arrangement of the bracket elements 41, 42, 43 repeats along the longitudinal axis z, such that the next three adjacent tube sections 31, 32, 33 are again referred to as first, second, or third tube sections 31, 32, 33.

As can be seen in particular from FIGS. 3, 4, and 6, the at least one first bracket element 41 has a first end section 41*c* and an opposite second end section 41*e*, wherein the two end sections 41*c*, 41*e* are connected to one another by a curved middle section 41*d* of the first bracket element 41, wherein the lower face 41*a* of the first bracket element 41 in the region of the middle section 41*d* rests against the first tube section 31. Thereby, the middle section 41*d* encompasses the first tube section 31 in sections in the circumferential direction U of the first tube section 31 at an upper face, facing away from the web 10, of the first tube section 31. To fix the first tube section 31 to the web 10 by means of the first bracket element 41, the two end sections 41*c*, 41*e* are in each case now connected to the web 10 via a welded connection S.

The first securing region 411, already described above and provided on the middle section 41*d*, of the first bracket element 41, is thereby connected to a first end section 42*c* of a second bracket element 42 via a welded connection S. Since the lower face 41*a* of the first bracket element 41 in the region of the middle section 41*d* of the first bracket element 41 rests against the first tube section 31, the first bracket element 41 or the first securing region 411 together with the first tube section 31 enclose the associated depression 401 as a cavity (cf. detail D of FIGS. 3 and 4). This cavity 401 protects the first tube section 31 from excessive heat when establishing the specified welded connection S between the first securing region 411 of the first bracket element and the first end section 42*c* of the second bracket element 42.

Furthermore, for fixing the second tube section 32 adjacent to the first tube section 31 to the web 10, the second bracket element 42 in turn rests with a lower face 42*a* facing the second tube section 32 against the second tube section 32. The second bracket element 42 has an opposite second end section 42*e* next to the first end section 42*c*, wherein the two end sections 42*c*, 42*e* of the second bracket element 42 are in turn connected to one another via a middle section 42*d* of the second bracket element 42. The lower face 42*a* of the second bracket element 42 rests in the region of the middle section 42*d* of the second bracket element 42 against the second tube section 32 and thereby encompasses the second tube section 32 in a circumferential direction U of the second tube section 32 in sections on an upper face, facing away from the web 10, of the second tube section 32.

While, as already explained above, the first end section 42*c* of the second bracket element 42 is arranged adjacently to the first securing region 411 of the first bracket element 41 and is connected thereto via a welded connection S, the second end section 42*e* of the second bracket element 42 is, conversely, connected to the web 10 via a welded connection S. Thus, the second bracket element 42 is connected, on the one hand, to the first bracket element 41 and, on the other, to the web 10, in order to fix the second tube section 32 on the web 10.

The second bracket element 42 also has in its middle section 42*d* (see detail D of FIG. 3 or 4) a securing region 421, which forms an elevation 400 on an upper face 42*a*, facing away from the lower face 42*a*, of the second bracket element 42, and which forms a depression 401 on the lower face 42*a* of the second bracket element 42, wherein the securing region 421 of the second bracket element 42 is connected via a welded connection S to the first end section 43*c* of a third bracket element 43.

Since, here as well, the lower face 42*a* of the second bracket element 42 in the region of the middle section 41*d* of the second bracket element 42 rests against the second tube section 32, the second bracket element 42 or the securing region 421 together with the second tube section 32 also encloses the associated depression 401 as a cavity, which protects the second tube section 32 from excessive heat during the production of the welded connection S between the securing region 421 and the first end section 43*c* of the third bracket element 43.

The third bracket element 43 serves to fix a third tube section 33, which runs adjacently to the second tube section 32 and rests against the web 10. Thereby, the third bracket element 43 rests with a lower face 43*a*, facing the third tube section 33, against the third tube section 33, wherein the third bracket element 43 has an opposite second end section 43*e* next to the first end section 43*c*, wherein the two end sections 43*c*, 43*e* of the third bracket element 43 are in turn connected to one another via a middle section 43*d* of the third bracket element 43. The lower face 43*a* of the third bracket element 43 rests, in the region of the middle section 43*d* of the third bracket element 43, against an upper face, facing away from the web 10, of the third tube section 33, wherein the second end section 43*e* of the third bracket element 43 is connected to a second securing region 412 of an additional first bracket element 41 (cf., in particular, FIG. 4). This second securing region 412 is opposite the first securing region 411 of the additional first bracket element 41 in a circumferential direction U of the first tube section 31 encompassed by the additional first bracket element 41. The second securing region 413 of the additional first bracket element 41 is formed analogously to the first securing region 411, i.e., it in turn encloses a depression 401 with the respective first tube section 31, which protects this tube section 31 from excessive heat generation when establishing a welded connection between the second securing region 412 of the additional first bracket element 41 and the second end section 43*e* of the third bracket element 43. The arrangement of the first, second, and third bracket elements 41, 42, 43 described above then begins again with the additional first bracket element 41 (cf., in particular, FIG. 4).

As can be seen in particular from FIGS. 4 and 6, the third bracket element 43 does not have a raised securing region, but instead extends from the securing region 421 of the adjacent second bracket element 42 to the second securing region 412 of the adjacent additional first bracket element 41. This means, in particular, that the third bracket element 43 is not connected directly to the web 10 via welded connections.

According to FIG. 5, the next web 10, which is located further outwards in the radial direction R of the tube bundle 3, is now secured to the web 10 below it via the first bracket elements 41 arranged along the longitudinal axis z. On this web 10, which is arranged radially further outwards, the tube or tubes 30 or tube sections 31, 32, 33 of the next tube layer 4 are then fixed, and, in particular, in the manner described above.

In order to describe the connection between the first bracket elements 41 and the webs 10 arranged above them, which are located radially further outwards, the middle section 41*d* of a first bracket element 41 is first described in more detail below by way of example (cf., in particular, FIGS. 3 and 5).

The middle section 41*d* of the first bracket element 41, which is considered here by way of example, is preferably formed to be wider in FIG. 3 in an axial direction A of the first tube section 31 than the web 10, at which the two end sections 41*c*, 41*e* of the first bracket element 41 are fixed via welded connections S (cf. also FIG. 6).

On the middle section 41*d*, for fixing the web 10 located further outwards in the radial direction R (cf. also FIG. 5), a third and a fourth securing region 413, 414 are now provided, which are opposite one another in the axial direction A and are spaced apart from one another in such a way that the web 10, which is located radially further outwards, can be arranged between these two securing regions 413, 414 on the middle section 41*d* of the first securing bracket 41 (and on the middle sections of the additional first securing brackets 41 arranged along the longitudinal axis z), such that it runs parallel to the web 10 located below it. The web 10, which is located radially further outwards, thereby rests with two bases 13, 14 on the first tube section 31, which is encompassed by the first bracket element 41. For this purpose, the first bracket element 41 has at its middle section 41*d* two passage openings 44, 45, which lie opposite one another in the axial direction A and each leave a surface region 34, 35 of the first tube section 31 free (see FIG. 3), wherein the bases 13, 14 each engage in an associated passage opening 44, 45 and thereby rest on or against each associated surface region 34, 35 of the first tube section 31.

The third securing region 413 of the first bracket element 41 is connected to an adjacent edge of the web 10, which is located further outwards in the radial direction R, via a welded connection S, as is shown, in particular, in FIG. 5. Furthermore, the fourth securing region 414 is connected to an opposite edge of the web 10, which is located further outwards in the radial direction R, via a welded connection S.

In this manner, the webs 10, lying one above the other in the radial direction R, of the tube bundle 3 can be connected to one another via the first bracket elements 41 arranged between them. Thereby, the first bracket elements 41 are welded, on the one hand, via their end sections 41*c*, 41*e* to the web 10 located further inwards in the radial direction R and, on the other, via the third and fourth securing regions 413, 414 to the web 10 located further outwards in the radial direction R.

Thereby, the third and fourth securing regions 413, 414 according to detail D of FIGS. 3 and 4 are also formed. That is, the third or fourth securing regions 413, 414 each enclose a depression 401 or a cavity 401 on the inner side 41*a*, 41*b* of the middle section 41*d* together with the respective first tube section 31, such that the respective first tube section 31 is in turn protected from excessive heat generation if the corresponding third and fourth securing regions 413, 414 are welded to the associated web 10.

The welded connections S between the bracket elements 41, 42, 43 and the webs 10 can be successively produced when the tubes 30 are wound onto the core tube 300. Thereby, the tube sections 31, 32, 33 of a tube layer 4 come to rest on the respective web 10 and are connected to the respective web 10 in the manner described above, one after the other, via the bracket elements 41, 42, 43. If the current tube layer 4 is completed, webs 10 are arranged above the bracket elements 41, 42, 43 of the tube layer 4 and are connected to the third and fourth securing regions 413, 414 of the first bracket elements 41 of the finished wound tube layer 4 by means of welded connections S. One or more tubes 30 are then wound again onto these webs 10, which are located radially further outwards, and are in turn secured to these webs 10 in the manner described with the bracket elements 41, 42, 43. This process can be repeated until the desired number of tube layers 4 is reached.

| List of reference signs | |
|---|---|
| 1 | Heat exchanger |
| 3 | Tube bundle |
| 4 | Tube layer |
| 5 | Jacket |
| 6 | Jacket space |
| 7 | Shroud |
| 10 | Web |
| 10a | Upper face |
| 10b | Lower face |

-continued

| List of reference signs | |
|---|---|
| 11, 12 | Leg |
| 15 | Recess |
| 30 | Tubes |
| 31, 32, 33 | Tube section |
| 34, 35 | Surface region |
| 41 | First bracket element |
| 42 | Second bracket element |
| 43 | Third bracket element |
| 44, 45 | Passage opening |
| 50, 51, 52, 53 | Connecting piece |
| 400 | Elevation |
| 401 | Depression |
| 411, 412, 413, 414 | Securing region |
| 421 | Securing region |
| 300 | Core tube |
| M | First medium |
| M' | Second medium |
| R | Radial direction |
| S | Welded connection |
| U | Circumferential direction |
| Z | Longitudinal axis |

The invention claimed is:

1. A heat exchanger (1), comprising:

a tube bundle (3) having at least one tube (30) for receiving a fluid medium (M), wherein the at least one tube (30) is wound around a core tube which extends along a longitudinal axis (z), wherein the at least one tube (30) rests with a first tube section (31) against at least one web (10) which extends along the core tube (300), and at least one first bracket element (41) for fixing the first tube section (31) on the at least one web (10), wherein the at least one first bracket element (41) rests with a lower face (41*a*) facing the first tube section (31) against the first tube section (31), wherein the at least one first bracket element (41) has at least one first securing region (411), which forms an elevation (400) on an upper face (41*b*), facing away from the lower face (41*a*), of the at least one first bracket element (41), and which forms a depression (401) on the lower face (41*a*) of the at least one first bracket element (41), and wherein the at least one first securing region (411, 412, 413, 414) of the at least one first bracket element (41) is welded to an additional bracket element (42, 43) or to an additional web (10) via a welded connection (S).

2. The heat exchanger as recited in claim 1, wherein the at least one first bracket element (41) has a first end section (41*c*) and an opposite second end section (41*e*), wherein the two end sections (41*c*, 41*e*) are connected to one another via a curved middle section (41*d*) of the at least one first bracket element (41), wherein the middle section (41*d*) rests against the first tube section (31), and wherein the first end section (41*c*) is connected to the at least one web (10) via a welded connection (S), and wherein the second end section (41*e*) is connected to the at least one web (10) via a welded connection (S).

3. The heat exchanger as recited in claim 1, wherein the at least one first securing region (411) of the at least one first bracket element (41) is formed on the middle section (41*d*) of the at least one first bracket element (41) and is connected to a first end section (42*c*) of a second bracket element (42) via a welded connection (S).

4. The heat exchanger as recited in claim 2, wherein the at least one first bracket element (41) has a second securing region (412), which forms an elevation (400) on the upper face (41*b*) of the at least one first bracket element (401) and which forms a depression (401) on the lower face (41*a*) of the at least one first bracket element (41), wherein the second securing region (412) is formed on the middle section (41*d*) of the at least one first bracket element (41) and is opposite the first securing region (411) in a circumferential direction (U) of the first tube section (31), wherein the second securing region (412) is connected to a second end section (43*e*) of a third bracket element (43) via a welded connection (S).

5. The heat exchanger as recited in claim 2, wherein the middle section (41*d*) of the at least one first bracket element (41) is wider in an axial direction (A) of the first tube section (31) than the two end sections (41*c*, 41*e*) of the at least one first bracket element (41), and/or in that the middle section (41*d*) of the at least one first bracket element (41) has a greater length in the axial direction (A) than in a circumferential direction (U) of the first tube section (31), and/or in that the middle section (41*d*) of the at least one first bracket element is wider in the axial direction (A) than the at least one web (10).

6. The heat exchanger as recited in claim 2, wherein, on the middle section (41*d*) of the at least one first bracket element (41), a third securing region (413) is provided, which forms an elevation (400) on the upper face (41*b*) of the at least one first bracket element (41), and which forms a depression (401) on the lower face (401) of the at least one first bracket element (41), wherein the third securing region (413) is connected to an additional web (10) of the tube bundle (3) of the heat exchanger (1) via a welded connection (S).

7. The heat exchanger as recited in claim 6, wherein, on the middle section (41*d*) of the at least one first bracket element (41), a fourth securing region (414) is provided, which forms an elevation (400) on the upper face (41*b*) of the at least one first bracket element (41), and which forms a depression (401) on the lower face (41*a*) of the at least one first bracket element (41), wherein the fourth securing region (414) is opposite the third securing region (413) in an axial direction (A) of the first tube section (31), and wherein the fourth securing region (414) is connected to the additional web (10) of the tube bundle (3) of the heat exchanger (1) via a welded connection (S).

8. The heat exchanger as recited in claim 4, wherein the first and second securing regions (411, 412) are arranged in an axial direction (A) between a third and fourth securing regions (413, 414) on the middle section (41*d*) of the at least one first bracket element (41).

9. The heat exchanger as recited in claim 2, wherein the middle section (41*d*) of the at least one first bracket element (41) has a first and a second passage opening (44, 45), such that the middle section (41*d*) resting against the first tube section (31) leaves a first and a second surface region (34, 35) of the first tube section (31) free, wherein the additional web (10) rests, with a first base (13), on the first surface region (34) and, with a second base (14), on the second surface region (35) of the tube section (31).

10. The heat exchanger as recited in claim 3, wherein the second bracket element (42), for fixing a second tube section (32) of a tube (30) of the tube bundle (3), which extends adjacently to the first tube section (31) and rests against the at least one web (10), rests, with a lower face (42*a*) facing the second tube section (32), against the second tube section (32), wherein the second bracket element (42) has a first end section (42*c*) and an opposite second end section (42*e*), wherein the two end sections (42*c*, 42*e*) of the second bracket element (42) are connected to one another via a middle section (42*d*) of the second bracket element (42), wherein the middle section (42*d*) of the second bracket element (42) rests against the second tube section (32), and wherein the first end section (42*c*) of the second bracket element (42) is connected to the first securing region (411) of the at least one first bracket element (41) via a welded connection (S), and wherein the second end section (42*e*) of the second bracket element (42) is connected to the web (10) via a welded connection (S).

11. The heat exchanger as recited in claim 10, wherein the second bracket element (42) has, in its middle section (42*d*), a securing region (421), which forms an elevation (400) on an upper face (42*a*), facing away from the lower face (42*a*), of the second bracket element (42), and which forms a depression (401) on the lower face (42*a*) of the second bracket element (42), wherein the securing region (421) of the second bracket element (42) is connected to a third bracket element (43) via a welded connection (S).

12. The heat exchanger as recited in claim 11, wherein the third bracket element (43) is provided for fixing a third tube section (33) of a tube (30) of the tube bundle (3), which runs adjacently to the second tube section (32) and rests against the at least one web (10), with a lower face (43*a*), facing the third tube section (33), of the third bracket element (43) resting against the third tube section (33), wherein the third bracket element (43) has a first end section (43*c*) and an opposite second end section (43*e*), wherein the two end sections (43*c*, 43*e*) of the third bracket element (43) are connected to one another via a middle section (43*d*) of the third bracket element (43), and wherein the middle section (43*d*) of the third bracket element (43) rests against the third tube section (33), and wherein the first end section (43*c*) of the third bracket element (43) is connected to the securing region (421) of the second bracket element (42) via a welded connection (S), and wherein the second end section (43*e*) of the third bracket element (43) is connected to a second securing region (412) of an additional first bracket element (41) via a welded connection (S).

13. The heat exchanger as recited in claim 7, wherein the first and second securing regions (411, 412) are arranged in an axial direction (A) between the third and fourth securing regions (413, 414) on the middle section (41*d*) of the at least one first bracket element (41).

* * * * *